US009347027B2

(12) United States Patent
Manna et al.

(10) Patent No.: US 9,347,027 B2
(45) Date of Patent: May 24, 2016

(54) AUTOMATIC DISHWASHING DETERGENT

(71) Applicant: Rohm and Haas Company, Philadelphia, PA (US)

(72) Inventors: Joseph Manna, Qakertown, PA (US); Jan Shulman, Newton, PA (US); Allen Bulick, East Norriton, PA (US)

(73) Assignee: Rohm and Haas Company

( * ) Notice: Subject to any disclaimer, the term of this patent is extended or adjusted under 35 U.S.C. 154(b) by 0 days.

(21) Appl. No.: 14/439,369

(22) PCT Filed: Nov. 21, 2013

(86) PCT No.: PCT/US2013/071168

§ 371 (c)(1),
(2) Date: Apr. 29, 2015

(87) PCT Pub. No.: WO2014/099237

PCT Pub. Date: Jun. 26, 2014

(65) Prior Publication Data

US 2015/0291916 A1 Oct. 15, 2015

Related U.S. Application Data

(60) Provisional application No. 61/739,262, filed on Dec. 19, 2012.

(51) Int. Cl.

| | |
|---|---|
| ***C11D 1/00*** | (2006.01) |
| ***C11D 3/02*** | (2006.01) |
| ***B08B 3/04*** | (2006.01) |
| ***C11D 3/37*** | (2006.01) |

(52) U.S. Cl.
CPC ..... *C11D 3/3757* (2013.01); *C11D 3/3769* (2013.01)

(58) Field of Classification Search
CPC ..... C11D 1/00; C11D 3/02; C11D 3/3769
See application file for complete search history.

(56) References Cited

U.S. PATENT DOCUMENTS

| | | | | |
|---|---|---|---|---|
| 3,331,773 | A | 7/1967 | Gunderson et al. | |
| 4,171,988 | A | 10/1979 | Phillips et al. | |
| 4,708,854 | A | 11/1987 | Grinstead | |
| 5,548,049 | A | 8/1996 | Brehm et al. | |
| 5,866,660 | A | 2/1999 | Kabanov et al. | |
| 2008/0262192 | A1 | 10/2008 | Yoneda | |
| 2010/0029536 | A1 * | 2/2010 | Warkotsch | C11D 3/2086 510/228 |
| 2011/0183880 | A1 * | 7/2011 | Yoneda | C08F 216/1458 510/299 |
| 2011/0224118 | A1 | 9/2011 | Creamer et al. | |

FOREIGN PATENT DOCUMENTS

| | | | | |
|---|---|---|---|---|
| GB | 1215116 | | 12/1970 | |
| JP | 5302288 | A | 11/1993 | |
| JP | 5311194 | A | 11/1993 | |
| WO | 01/81365 | A2 | 11/2001 | |
| WO | 02/47472 | A1 | 6/2002 | |
| WO | 2007/089001 | A1 | 8/2007 | |
| WO | WO 2013/066934 | * | 5/2013 | C08F 16/28 |

* cited by examiner

*Primary Examiner* — Brian P Mruk

(57) ABSTRACT

Described are dishwashing detergents, comprising a builder, a surfactant, and a polymer comprising units derived from an ethylenically unsaturated aminocarboxylate monomer having Formula (I): wherein m is 1, 2, or 3, n is, independently at each occurrence, 1, 2, or 3, $R_1$ is H or C1-C4 alkyl, $R_2$ is $H_2$ or =O, X is, independently, H, $K^+$, $Na^+$, or $NH_4^+$, and an ethylenically unsaturated monomer selected from (meth)acrylic acid.

(I)

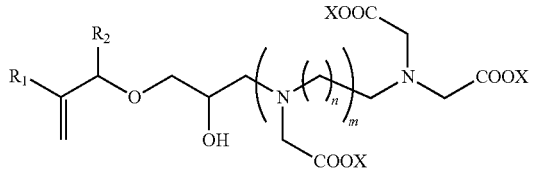

12 Claims, No Drawings

AUTOMATIC DISHWASHING DETERGENT

CROSS REFERENCE TO RELATED APPLICATIONS

This application is a 35 USC §371 national phase filing of PCT/US2013/071168 filed Nov. 21, 2013, which claims the benefit of U.S. Application No. 61/739,262, filed Dec. 19, 2012.

FIELD

The present invention relates to automatic dishwashing detergent.

BACKGROUND

Historically, phosphates have been used as builders for detergents, due to their excellent chelating agent performance. However, due to aquatic plant stimulation effects, most jurisdictions have limited or banned the use of phosphates in detergents.

Accordingly, there is an important need in the art for new and effective chelating agents, dispersants, and/or builders for automatic dishwashing detergents.

DETAILED DESCRIPTION

In one embodiment, the present invention provides dishwashing detergents, comprising a builder, a surfactant, and a polymer comprising units derived from an ethylenically unsaturated am inocarboxylate monomer having Formula I:

(I)

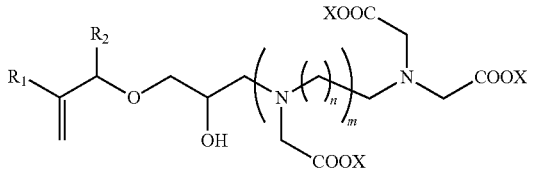

wherein m is 1, 2, or 3, n is, independently at each occurrence, 1, 2, or 3, $R_1$ is H or C1-C4 alkyl, $R_2$ is $H_2$ or =O, X is, independently, H, $K^+$, $Na^+$, or Ammonium ($NH_4^+$), and an ethylenically unsaturated monomer selected from (meth) acrylic acid. As used herein, the term "(meth)acrylic" is a convenient way to refer to acrylic acid and/or methacrylic acid, meaning either acrylic acid, methacrylic acid, or both. Alternatively to X, an organic amine can be used as a neutralizer, for example, monoethanol amine.

In one embodiment, the builder is at least one of sodium citrate, citric acid, or sodium carbonate.

In one embodiment, the surfactant is at least one typically used in automatic dishwashing detergents, for example, low foam surfactants such as those that are optionally alkyl capped and containing an ethyleneoxy (EO), propyleneoxy (PO), or butyleneoxy (BO) backbone, or combinations of two or more thereof, including but not limited to, random or block copolymers, e.g, EO/PO, EO/PO/EO, EO/PO/BO, and further e.g., triblocks, or alkyl EO/PO/BO.

"Ethylenically unsaturated monomers" means molecules having one or more carbon-carbon double bonds, which renders them polymerizable. As used herein, ethylenically unsaturated monomers include, without limitation, carboxylic acids, esters of carboxylic acids, carboxylic acid anhydrides, imides, amides, styrenes, sulfonic acids, and combinations thereof.

Without being bound by theory, the polymer appears to have excellent chelating ability. In one embodiment, the monomer of Formula I accounts for 1-50 wt. % of the polymer, preferably 5 to 15 wt % of said polymer. In one embodiment, the (meth)acrylic monomer accounts for 20-99 wt. % of the polymer.

In one embodiment of Formula I, m is 1.

In one embodiment of Formula I, n is 1.

In one embodiment of Formula I, $R_1$ is H. In one embodiment of Formula I, $R_2$ is $H_2$. This is can be achieved, for example, with an allyl glycidyl ether (AGE) monomer.

In one embodiment of Formula I, $R_2$ is =O. This is can be achieved, for example, with glycidyl (meth)acrylate monomer (GA or GMA).

In one embodiment, the polymer further comprises an ethylenically unsaturated monomer selected from esters of (meth)acrylic acids and C1-C12 aliphatic alcohols. In one embodiment, this monomer is present in 1-30 wt. % of the polymer.

In one embodiment, the polymer further comprises an ethylenically unsaturated monomer selected from amides of (meth)acrylic acids, including those with C1-C6 aliphatic alkyls. In one embodiment, this monomer is present in 1-30 wt. % of the polymer.

In one embodiment, the polymer further comprises one or more ethylenically unsaturated monomers selected from the group consisting of esters of carboxylic acids, carboxylic acid anhydrides, imides, amides, styrenes, sulfonic acids, and combinations thereof. In one embodiment, this monomer is present in 1-30 wt. % of the polymer.

Carboxylic acid monomers include, for example, acrylic acid, methacrylic acid, and salts and mixtures thereof. Sulfonic acid monomers include, for example, 2-(meth)acrylamido-2-methylpropanesulfonic acid, 4-styrenesulfonic acid, vinylsulfonic acid, 2-sulfoethyl(meth)acrylic acid, 2-sulfopropyl(meth)acrylic acid, 3-sulfopropyl(meth)acrylic acid, and 4-sulfobutyl(meth)acrylic acid and salts thereof. Further examples of ethylenically unsaturated monomers include, without limitation, itaconic acid, maleic acid, maleic anhydride, crotonic acid, vinyl acetic acid, acryloxypropionic acid, methyl acrylate, ethyl acrylate, butyl acrylate, methyl methacrylate, ethyl methacrylate, butyl methacrylate and isobutyl methacrylate; hydroxyalkyl esters of acrylic or methacrylic acids such as hydroxyethyl acrylate, hydroxypropyl acrylate, hydroxyethyl methacrylate, and hydroxypropyl methacrylate; acrylamide, methacrylamide, N-tertiary butyl acrylamide, N-methyl acrylamide, N,N-dimethyl acrylamide; acrylonitrile, methacryionitrile, allyl alcohol, allyl sulfonic acid, allyl phosphonic acid, vinylphosphonic acid, dimethylaminoethyl acrylate, dimethylaminoethyl methacrylate, phosphoethyl methacrylate, phosphonoethyl methacrylate (PEM), and sulfonoethyl methacrylate (SEM), N-vinyl pyrollidone, N-vinylformamide, N-vinylimidazole, ethylene glycol diacrylate, trimethylotpropane triacrylate, diallyl phthalate, vinyl acetate, styrene, divinyl benzene, allyl acrylate, 2-acrylamido-2-methyl propane sulfonic acid (AMPS) and its salts or combinations thereof.

In one embodiment, the detergent further comprises at least one bleaching agent, aminocarboxylate, or enzyme. A preferred bleaching agent is sodium percarbonate. Exemplary aminocarboxylates include methylglycine diacetic acid (MGDA), glutamic acid diacetic acid (GLDA), and their sodium salts, and 2-hydroxyethyliminodiacetic acid disodium salt (HEIDA). In one embodiment, the enzyme is at least one of lipases, proteases, or amylases.

In one embodiment, the detergent further comprises a phosphonate, preferably hydroxyethyldiphosphonic acid (HEDP).

In one embodiment, the detergent is a phosphate-free detergent.

In one embodiment, the detergent further comprises fragrances; solvents ((i.e. Polyglycol, alcohol, diol, triol, glycol ethers), water); coupling agents (SXS, SCS); filler/adjuvants (sodium sulfate, sodium chloride); binders (PEG); disintegrants (superabsorbent polymer, cellulosic); or corrosion inhibitors (silicates).

In one embodiment, the polymer of Formula I may be prepared by first reacting ethylenediamine triacetic acid (ED3A), or its salt, with allyl glycidyl ether (AGE) or glycidyl (meth)acrylate (GA or GMA). Resulting monomers include ED3A-AGE, ED3A-GA, and ED3A-GMA. In practice, a mixture of isomers results. If desired, further reaction with additional quantities of chloroacetic acid can increase yields in situations that would be recognized by those skilled in the art.

The method of polymerization is not particularly limited and may be any method known, now or in the future, to persons of ordinary skill including, but not limited to, emulsion, solution, addition and free-radical polymerization techniques.

When initiator is used, it may be added in any fashion, at any time during the process. Production of the polymer may also involve the use of a chain regulator.

In use, the polymer can be used in compositions for automatic dishwash, or industrial warewash, machines. In practice, such compositions can be formulated in any conventional form, such as tablets, powders, monodose units, multicomponent monodose units, sachets, pastes, liquids, or gels. With selection of an appropriate product form and addition time, the polymer composition may be present in the prewash, main wash, penultimate rinse, final rinse, or any combination of these cycles. The polymer is contemplated to be present in such compositions from 0.5 wt. % to 40 wt. %, preferably from 3 wt. % to 30 wt. %, more preferably 5 wt. % to 20 wt. %.

EXAMPLES

Example 1

Synthesis of ED3A-AGE

To a 1 L round bottom flask equipped with a magnetic stirbar and an addition funnel, 172 g of N,N,N'-ethylenediaminetriacetic acid, sodium salt (ED3A) solution (29% active) is charged. The solution is placed in a water bath, and set to stir at a minimum of 300 rpm. 0.4 g of benzyltrimethylammonium chloride (BTAC)) is charged to the vessel and allowed to dissolve completely over approximately five minutes. During this time, 18.85 g of allyl glycidyl ether (AGE) is charged to the addition funnel. The AGE is added dropwise to the stirring reaction mass, and when complete, allowed to stir at room temperature until the reaction mass transitioned from two phases to a single phase. This is determined by visual observation, in which prior to completion, the reaction mass is hazy, and separates into two distinct phases upon termination of stirring. Upon completion, the reaction mass is observed to be a transparent yellow solution, which is stable upon termination of stirring. At this stage the product is a yellow solution of pH 11.5 and active level of 37.5 wt. % ED3A-AGE. This solution is stable to storage under ambient conditions and can be used as such.

Synthesis of Poly-(Acrylic Acid/ED3A-AGE)

Polymer 1:

To a three liter round bottom flask, equipped with a mechanical stirrer, heating mantle, thermocouple, condenser and inlets for the addition of monomer, initiator and chain regulator are charged 30 g of ED3A-AGE crude solution (37.5% active) and 60.1 g deionized water. The solution is stirred and 6.1 g of sulfuric acid is slowly added until the pH of the solution is below 3.0. The stirring solution is heated to 78° C. (±2° C.). In the meantime, a monomer solution of 213.75 g of glacial acrylic acid is added to a graduated cylinder for addition to the flask. An initiator solution of 6.0 g of sodium persulfate is dissolved in 50 g of deionized water and added to a syringe for addition to the kettle. A chain regulator solution of 32.4 g of sodium metabisulfite dissolved in 120 g of deionized water is added to a syringe for addition to the kettle. A promoter solution of 0.75 g of a 0.15% iron (II) sulfate heptahydrate solution is added to a vial and set aside.

Once the kettle contents reached reaction temperature of 78° C., the promoter solution is added. After the reaction temperature recovered to 78° C., the monomer, initiator and CTA solutions are begun. The monomer feed is added over 90 minutes, CTA cofeed added over 80 minutes and initiator cofeed added over 95 minutes at 78° C. At the completion of the feeds, 5 g of deionized water is added to the monomer feed vessel, as rinse. The reaction is held for 15 minutes at 78° C. In the meantime, the chaser solutions of 0.87 g of sodium metabisulfite and 25 g of deionized water are mixed and set aside, and 0.29 g of sodium persulfate and 5 g of deionized water are mixed and set aside.

At the completion of the hold, the above solutions are added linearly over 10 minutes and held for 20 minutes at 78° C. The chaser solution preparations are repeated and added to the kettle over 10 minutes, followed by a 20 minute hold.

At the completion of the final hold, a solution of 229.9 g of 50% sodium hydroxide is added to an addition funnel and slowly added to the kettle, controlling the exotherm to keep the temperature below 65° C. Finally, 5.7 g of a scavenger solution of 35% hydrogen peroxide is added to the kettle. The reaction is then cooled and packaged. The final polymer had a solids content of 41.12% (as measured in a forced draft oven at 150° C. for 60 minutes). The pH of the solution is 7.44 and final molecular weight as measured by GPC is 8,437 daltons.

Polymer 2:

Substantially as above, except: 90 g of ED3A-AGE crude solution (37.5% active) and 17.3 g of sulfuric acid, and later, 191.25 g of glacial acrylic acid is added. The chain regulator solution was 37.13 g of sodium metabisulfite dissolved in 120 g of deionized water. At the completion of the final hold, a solution of 218 g of 50% sodium hydroxide is added. A 4.8 g of a scavenger solution of 35% hydrogen peroxide is added. The final polymer had a solids content of 41.53% (same conditions). The pH of the solution is 7.29 and final molecular weight as measured by GPC is 7,523 daltons.

Polymer 3:

Substantially as above, except: 357.01 g of ED3A-AGE crude solution (37.5% active) and 11.2 g of sulfuric acid, and later 203.64 g of glacial acrylic acid is added. The chain regulator solution was 30.0 g of sodium metabisulfite dissolved in 120 g of deionized water. At the completion of the final hold, a solution of 222 g of 50% sodium hydroxide is added. A 5.2 g of a scavenger solution of 35% hydrogen peroxide is added. The final polymer had a solids content of 40.68% (same conditions). The pH of the solution is 7.24 and final molecular weight as measured by GPC is 9,851 daltons.

Weight average molecular weights, Mw, are measured by gel permeation chromatography (GPC) using polyacrylic acid standards, as is known in the art.

A summary of the polymer properties are listed in TABLE 1:

TABLE 1

| | Composition | SMBS CTA (%) | % Solids | pH | Visc. (cps) | Mw |
|---|---|---|---|---|---|---|
| Polymer 1 | 95% AA/5% ED3A-AGE | 14.4 | 41.12 | 7.44 | 223 | 8,437 |
| Polymer 2 | 85% AA/15% ED3A-AGE | 16.5 | 41.53 | 7.29 | 124 | 7,523 |
| Polymer 3 | 90.5% AA/9.5% ED3A-AGE | 13.3 | 40.68 | 7.24 | 203 | 9,851 |

Example 2

Exemplary dishwashing detergents according to the present invention are listed in TABLE 2 (in wt. %):

TABLE 2

| | Formula 1 | Formula 2 | Formula 3 | Formula 4 | Formula 5 | Formula 6 |
|---|---|---|---|---|---|---|
| Polymer 1 | 10 | 20 | — | — | — | — |
| Polymer 2 | — | — | 10 | 20 | — | — |
| Polymer 3 | — | — | — | — | 10 | 20 |
| Sodium Carbonate | 20 | 20 | 20 | 20 | 20 | 20 |
| Sodium Bicarbonate | 10 | 10 | 10 | 10 | 10 | 10 |
| BRITESIL ® H20 Disilicate | 5 | 5 | 5 | 5 | 5 | 5 |
| Percarbonate | 15 | 15 | 15 | 15 | 15 | 15 |
| TERGITOL ® L-61 surfactant | 2 | 2 | 2 | 2 | 2 | 2 |
| ACUSOL ® 445ND/445NG dispersant | 1 | 1 | 1 | 1 | 1 | 1 |
| Sodium Sulfate | Balance | Balance | Balance | Balance | Balance | Balance |

The formulations are prepared conventionally using the polymers of Example 1.

Comparative Example 3

A comparative dishwashing detergent is listed in TABLE 3 (in wt. %):

TABLE 3

| | Comparative Formula A |
|---|---|
| TRILON ® M MGDA | 20 |
| Sodium Carbonate | 20 |
| Sodium Bicarbonate | 10 |
| BRITESIL ® H20 Disilicate | 5 |
| Percarbonate | 15 |

TABLE 3-continued

| | Comparative Formula A |
|---|---|
| TERGITOL ® L-61 surfactant | 2 |
| ACUSOL ® 445ND/445NG dispersant | 1 |
| Sodium Sulfate | Balance |

Example 4

To determine filming and spotting performance of automatic dishwashing detergents, the compositions of Examples 2 and 3 were tested in Miele LP 1222 laboratory machines (using the 50° C. "normal" wash program) loaded with 3 Wine glasses (Carrefour, 24cl), and a load of clean porcelain plates, melamine plastic plates, and polypropylene plates, and steel cutlery. Before the individual scaling test, machines and ballast load have to be subjected to a minimum of one thorough wash in the commercial dishwasher at 65° C. before being used the first time in a test (conditioning process), followed by a consecutive acidic rinse.

Each formulation of Examples 2 and 3 is dosed as a 20 g powder formulation. The water hardness used is 21° dH (375 ppm, 3/1 Ca/Mg). Each run is done in presence of 50 g frozen ballast (IKW soil, Industrieverband Körperpflege and Waschmittel e.V., % content: Margarine (10.0); Milk (pasteurized, 3.5% fat) (5.0); Egg yolk (9.4); Benzoic acid (0.1); Potato Starch (0.5); Mustard (2.5); Ketchup (2.5); Water (70.0)). The machines are run for 5 complete cycles, each time adding new detergent and ballast soil load sample. The glasses are removed after the first, third, and fifth cycle.

Filming performance is assessed by trained panelists, and handled with cotton gloves. The evaluation is performed according to ASTM D3556 Standard test method for deposition on glass ware during mechanical dishwashing (Designation D3556-85, re-approved 2009) following the scoring system given below in a light chamber (1 is best, no spotting, no filming; 2 is random spots and barely perceptible filming; 3 is about a fourth of the surface spotted, slight film; 4 is about half of the surface spotted, moderate film; and 5 is virtually completely covered with spots and heavy film).

Results are shown in Table 4:

TABLE 4

| | Form. 1 | Form. 2 | Form. 3 | Form. 4 | Form. 5 | Form. 6 | Comparative Formula A |
|---|---|---|---|---|---|---|---|
| 1 Cycle | 1.5 | 1.5 | 1.0 | 1.0 | 1.0 | 1.25 | 1.0 |
| 3 Cycles | 2.25 | 2.25 | 2.75 | 2.1 | 2.5 | 2.25 | 2.75 |
| 5 Cycles | 4.0 | 3.75 | 4.75 | 3.75 | 4.5 | 3.5 | 4.75 |

The inventive formulations met or exceeded performance of the comparative after the initial cycle.

Example 5

Exemplary dishwashing detergents according to the present invention are listed in TABLE 5 (in wt. %):

TABLE 5

| | Formula 7 | Formula 8 | Formula 9 | Formula 10 |
|---|---|---|---|---|
| At least one of Polymer 1, 2, or 3 | 10 | 10 | 15 | 20 |
| Sodium Citrate | 30 | 25 | | |

TABLE 5-continued

| | Formula 7 | Formula 8 | Formula 9 | Formula 10 |
|---|---|---|---|---|
| Sodium Carbonate | 20 | 20 | 20 | 20 |
| Sodium Bicarbonate | 10 | 10 | 10 | 10 |
| BRITESIL ® H20 Disilicate | 5 | 5 | 5 | 5 |
| Aminocarboxylate chelant | 20 | — | — | 10 |
| Percarbonate | 15 | 15 | 15 | 15 |
| Tetraacetylethylenediamine bleach activator | 3.5 | 3.5 | 3.5 | 3.5 |
| TRITON ® DF-16 surfactant | 1.5 | 1.5 | 1.5 | 1.5 |
| TERGITOL ® L-61 surfactant | 0.5 | 0.5 | 0.5 | 0.5 |
| ACUSOL ® 445ND/445NG dispersant | 2 | 2 | 2 | 2 |
| Sodium Sulfate | Balance | Balance | Balance | Balance |

The formulations are prepared conventionally using the polymers of Example 1. If desired, the formulations optionally can be modified to include protease and amylase enzymes at 0.5-1.0% and/or PEG 1500/8000 binder at 3-7%, with the sulfate reduced accordingly.

Example 6

Exemplary dishwashing detergents according to the present invention are listed in TABLE 6 (in wt. %):

TABLE 6

| | Formula 11 | Formula 12 | Formula 13 | Formula 14 | Formula 15 |
|---|---|---|---|---|---|
| At least one of Polymer 1, 2, or 3 | 10 | 10 | 15 | 20 | 5 |
| Sodium Citrate | — | 25 | 20 | — | 10 |
| Sodium Carbonate | 20 | 20 | 20 | 20 | 7.5 |
| Sodium Bicarbonate | 10 | 10 | 10 | 10 | — |
| BRITESIL ® H20 Disilicate | 5 | 5 | 5 | 5 | 12.5 |
| Aminocarboxylate chelant | 20 | — | — | 10 | — |
| Percarbonate | 15 | 15 | 15 | 15 | — |
| Tetraacetylethylene-diamine bleach activator | 3.5 | 3.5 | 3.5 | 3.5 | — |
| TRITON ® DF-16 surfactant | 1.5 | 1.5 | 1.5 | 1.5 | 4 |
| TERGITOL ® L-61 surfactant | 0.5 | 0.5 | 0.5 | 0.5 | 2 |
| Protease enzyme | 1 | 1 | 1 | 1 | 1 |
| Amylase enzyme | 1 | 1 | 1 | 1 | 1 |
| PEG 1500/8000 binder | 5 | 5 | 5 | 5 | — |
| HEDP Phosphonate | 0.5 | 0.5 | 0.5 | 0.5 | 0.5 |
| ACUSOL ® 445ND/445NG dispersant | 2 | 2 | 2 | 2 | 2 |
| PEG 300/Propylene Glycol non-aqueous solvent | — | — | — | — | 54.5 |
| Sodium Sulfate | Balance | — | — | Balance | — |

The formulations are prepared conventionally using the polymers of Example 1. Formula 15 is a unit dose sachet.

The invention claimed is:

1. A dishwashing detergent, comprising:

a builder;

a surfactant; and a polymer comprising units derived from:

an ethylenically unsaturated aminocarboxylate monomer having Formula I:

(I)

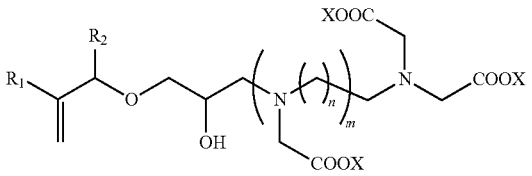

wherein:

m is 1, 2, or 3;

n is, independently at each occurrence, 1, 2, or 3;

$R_1$ is H or C1-C4 alkyl;

$R_2$ is $H_2$ or =O;

X is, independently, H, $K^+$, $Na^+$, or $NH_4^+$; and an ethylenically unsaturated monomer selected from (meth)acrylic acid.

2. The detergent of claim 1, wherein in Formula I, m is 1.

3. The detergent of claim 2, wherein in Formula I, n is 1.

4. The detergent of claim 1, wherein in Formula I, $R_2$ is $H_2$.

5. The detergent of claim 1, wherein in Formula I, $R_2$ is =O.

6. The detergent of claim 1, wherein the polymer further comprises an ethylenically unsaturated monomer selected from esters of (meth)acrylic acids and C1-C12 aliphatic alcohols.

7. The detergent of claim 1, wherein the polymer further comprises an ethylenically unsaturated monomer selected from amides of (meth)acrylic acids, including those with C1-C6 aliphatic alkyls.

8. The detergent of claim 1, wherein the polymer further comprises one or more ethylenically unsaturated monomers selected from the group consisting of carboxylic acids, esters of carboxylic acids, carboxylic acid anhydrides, imides, amides, styrenes, sulfonic acids, and combinations thereof.

9. The detergent of claim 1, wherein the detergent further comprises at least one bleaching agent, aminocarboxylate, or enzyme.

10. The detergent of claim 1, wherein the detergent further comprises a phosphonate.

11. The detergent of claim 1 wherein the polymer consists of units derived from the ethylenically unsaturated aminocarboxylate monomer of Formula I and (meth)acrylic acid.

12. A method of washing dishes in an automatic dishwashing machine, the method comprising: applying to the dishes the dishwashing detergent of claim 1.

* * * * *